US009021961B1

(12) United States Patent
Manole et al.

(10) Patent No.: US 9,021,961 B1
(45) Date of Patent: May 5, 2015

(54) ENHANCED STABILITY EXTENDED RANGE (GUIDANCE ADAPTABLE) 40 MM PROJECTILE

(71) Applicants: Leon Manole, Great Meadows, NJ (US); Arthur Ricardo Pizza, Maywood, NJ (US); Ernest Lee Logsdon, Newton, NJ (US); Gary Anthony Pacella, Stroudsburg, PA (US); Anthony J. Sebasto, Budd Lake, NJ (US); Wilfredo Toledo, Hasbrouck Heights, NJ (US); John Shelp, Cresco, PA (US)

(72) Inventors: Leon Manole, Great Meadows, NJ (US); Arthur Ricardo Pizza, Maywood, NJ (US); Ernest Lee Logsdon, Newton, NJ (US); Gary Anthony Pacella, Stroudsburg, PA (US); Anthony J. Sebasto, Budd Lake, NJ (US); Wilfredo Toledo, Hasbrouck Heights, NJ (US); John Shelp, Cresco, PA (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 152 days.

(21) Appl. No.: 13/788,326

(22) Filed: Mar. 7, 2013

Related U.S. Application Data

(60) Provisional application No. 61/613,161, filed on Mar. 20, 2012.

(51) Int. Cl.
*F42B 14/00* (2006.01)
*F42B 10/44* (2006.01)
*F42B 10/46* (2006.01)

(52) U.S. Cl.
CPC ..... *F42B 10/44* (2013.01); *F42B 10/46* (2013.01)

(58) Field of Classification Search
CPC ..... F42B 10/44; F42B 10/46
USPC ..... 102/524, 430, 501, 346, 357, 439
See application file for complete search history.

(56) References Cited

U.S. PATENT DOCUMENTS

| | | | | |
|---|---|---|---|---|
| 2,872,864 | A * | 2/1959 | Barnes et al. | 102/436 |
| 4,955,938 | A * | 9/1990 | Romer et al. | 102/430 |
| 6,575,098 | B2 * | 6/2003 | Hsiung | 102/498 |
| 6,588,700 | B2 * | 7/2003 | Moore et al. | 244/3.28 |
| 6,764,042 | B2 * | 7/2004 | Moore et al. | 244/3.28 |
| 7,526,998 | B2 * | 5/2009 | Vasel et al. | 102/502 |
| 8,171,853 | B2 * | 5/2012 | Purvis | 102/512 |
| 8,316,769 | B2 * | 11/2012 | Wilson | 102/444 |
| 8,413,586 | B2 * | 4/2013 | Van Stratum | 102/477 |
| 8,434,412 | B2 * | 5/2013 | Regebro | 102/501 |
| 8,640,621 | B2 * | 2/2014 | Broden et al. | 102/444 |
| 8,674,277 | B2 * | 3/2014 | Axford et al. | 244/3.21 |
| 2001/0039898 | A1 * | 11/2001 | Bar et al. | 102/501 |
| 2006/0011090 | A1 * | 1/2006 | Vasel et al. | 102/512 |
| 2007/0151473 | A1 * | 7/2007 | Brunn | 102/444 |
| 2008/0053330 | A1 * | 3/2008 | Haeselich | 102/513 |
| 2010/0101443 | A1 * | 4/2010 | Rosales et al. | 102/438 |
| 2010/0147177 | A1 * | 6/2010 | Van Stratum | 102/470 |
| 2010/0212529 | A1 * | 8/2010 | Van Stratum | 102/334 |
| 2010/0288152 | A1 * | 11/2010 | Luebbers | 102/430 |
| 2011/0079164 | A1 * | 4/2011 | Broden et al. | 102/444 |
| 2011/0174187 | A1 * | 7/2011 | Van Stratum | 102/464 |
| 2011/0226149 | A1 * | 9/2011 | Tepe et al. | 102/376 |
| 2012/0067242 | A1 * | 3/2012 | Shin et al. | 102/364 |
| 2013/0199396 | A1 * | 8/2013 | Broden et al. | 102/513 |
| 2013/0239836 | A1 * | 9/2013 | Aw et al. | 102/430 |

* cited by examiner

*Primary Examiner* — Bret Hayes
*Assistant Examiner* — Joshua Freeman
(74) *Attorney, Agent, or Firm* — Michael C. Sachs

(57) ABSTRACT

A cartridge launched in an M203/M320 gun launcher device, which cartridge has fins of 1-5 inches in length to insure flight stability without spinning the cartridge. The non spin makes the cartridge capable of having a guidance navigation and control, canard actuating system added between the body and nose. The guidance navigation and control, canard actuating system features now make the cartridge suitable for successfully attacking stationary and moving targets not heretofore possible.

11 Claims, 6 Drawing Sheets

ENHANCED STABILITY EXTENDED RANGE (GUIDANCE ADAPTABLE) 40 MM PROJECTILE

CROSS REFERENCE TO RELATED APPLICATION

This application claims benefit under 35 USC §119 (e) of the filing date of U.S. Provisional Patent Application No. 61/613,161 filed Mar. 20, 2012, the entire file wrapper contents of which application are hereby incorporated by reference herein as though fully set forth.

U.S. GOVERNMENT INTEREST

The inventions described herein may be made, used, or licensed by or for the U.S. Government for U.S. Government purposes.

BACKGROUND OF INVENTION

Projectiles currently used for the M203/M320 gun launcher devices include the M433 High Explosive Dual Purpose Round, M406 High Explosive Round, M583A1 Star Parachute Round, M585 White Star Cluster Round, M713 Ground Marker Round, M781 Practice Round, M651 CS Round and M576 Buckshot Round. The M203 is not a standalone gun. It must be attached to an M16 or M4 rifle, for instance, and fires a family of 40 mm low velocity projectile rounds. In order to load a 40 mm round into an M203, the forward sleeve of the gun tube is slid forward, and a 40 mm round is pushed into the sleeve. The sleeve is then slid backwards and locked into position, ready to fire. The barrel of the M203 is rifled, which spins up the projectile as it travels down the barrel tube, and the projectile leaves the gun tube with a high spin rate.

The 40 mm cartridge case is typically not reused or recycled after firing. If the cartridge case becomes stuck in the gun tube, there is a tool to help the war-fighter push it from the tube. The M320 gun launcher device fires the same 40 mm low velocity ammunition as does an M203. There are several improvements that the M320 has compared to the M203. The M320 has stand alone single shot capability and may be fired by a war-fighter without attaching to a gun. It also has the capability to be attached to and fired from an M16/M4 rifle, similarly to an M203 gun launcher device. A major improvement of the M320 is the ability of the firing tube to open sideways. By opening sideways, longer ammunition can be loaded into the M320 gun tube as compared to loading into an M203. While the approximate maximum length of the projectile is approximately five inches in the M203, projectiles several inches longer can be loaded into an M320. Both M203 and M320 have rifled barrels which induce spinning in the projectile as it travels through the gun tube.

There exists a great need to develop a new family of 40 mm projectiles that can have extended range through increased velocity and projectile shape to over 1000 meters; can provide capability for an add-on optional guidance-navigation and control ("GN&C") subsystem; can increase lethality through enhanced precision and accurate strikes; can increase projectile length which can accommodate more fragments and an increased amount of explosives and/or energetics; and can provide a novel system with much longer rear end fins, that can allow for greater stability, in applications which will no longer need any appreciable, or no, projectile spin for flight accuracy.

Currently, low velocity ("LV") 40 mm projectiles are length restricted by the presence of the loading system that is in the M203 gun. The 40 mm LV projectiles do not fly as well as desired, due to the inability to add fins for providing stability. Instead, 40mm LV projectiles are spin stabilized, which both do not fly as well as desired and also can not employ guidance systems due to these projectiles' extensive pitch, yaw and drag. Current guidance-navigation and control ("GN&C") subsystems can't function in a spin environment. Guided ammunition would need to have no spin (or very little spin) so that the seeker or camera therein, e.g., can see the target clearly while in flight. However, the conventional M203 or M320 grenade launcher guns do have spin since they have internal rifling intended to spin up the projectiles (at approximately 1800 revolutions per second) for stabilization of flight. Clearly then, a way must be found to avoid the spin which is inherent in conventional M203 or M320 grenade launcher guns when optional guidance is desired to be added to the projectile.

Recently developed new 40 mm projectiles of several varieties provide better performance, extended range, with reduced or no spin at all, and have the ability to have added on guidance and control systems to hit stationary targets. These novel technologies all allow for better performance, yet while reducing pitch, yaw, and/or drag. The stability of these projectiles are still somewhat limited by the length and area of their fins. These projectiles will fly well and have the ability to add guidance and control with small canards added in the front of the projectile, in a canard actuating system ("CAS"). Smaller (width and/or length) canards however would mean less control authority or less of an ability to make large course corrections while in flight. The projectiles' center of gravity ("CG") and center of pressure ("CP") needs to be a certain distance apart in order to provide a needed stability margin. In the case of fin stabilized projectiles, the CG needs to be in the front of the projectile while the CP needs to be in the rear of the projectile. Larger canards, and changing the position of the canards away from the front of the projectile, move the CP forward and begin to compromise or reduce the stability margin. By incorporating longer fins on a projectile with more surface area however, the CP is moved back and the projectile gains a better stability margin. With this greatly improved stability margin, larger canards can be positioned where needed. This improvement now allows for a projectile to have larger course corrections and hit harder targets such as moving targets. Optional guidance and control can now be added to the front or side of a projectile utilized for battle. The optional guidance and control provides increases accuracy and precision hits on targets up to and beyond 1000 meters (a goal which is sought). The obturator on the projectile prevents gases from blowing past it; it seals in the gases allowing a projectile to move with a constant rate push as it travels down the barrel of a gun launcher. The obturator must be positioned immediately behind of the cartridge case. This is because the M320 and M203 have both a section to seat the cartridge case, and then also enough room still, for the obturator before the rifling part of the gun tube is encountered. The obturator is higher than (near the end of) the projectile and therefore is found at the top of the gun tube. If the obturator were made too long in dimension, then the cartridge could not be loaded. This is since the obturator cannot be pushed into the rifling just by hand. Currently, there is an approximately one inch long of space in between the back of the obturator and the front of the (inside of the) cartridge case. This can only allow for fins that are one inch long therefore. The projectile continues on past the obturator by a distance of approximately 1/16 inch (press fit into the cartridge case) and then slopes down at an angle of 15 degrees, toward the end of the projectile. There is currently provided a housing for the fins at the end of the projectile, which housing functionally attaches the fins to the projectile. The fins physically now extend from the housing and up until the beginning of the interference fit with the cartridge case. Therefore the fins are approximately one inch long. The fins open up after exit from the gun. These finned projectiles have tested with excellent flight results, however, to add in a guidance and control (G&C) canard system as desired, the fins would not allow for larger and more aggressive canards and positioning. These projectiles are good for stationary targets. To hit moving and stationary targets, fins that are two inches or longer are needed. Therefore, what is greatly needed is to provide a low velocity 40 mm projectile with two or more inch long fins to allow for aggressive guidance and control CAS systems. In addition, aeroballistic modeling shows that the rear end of the projectile will have less drag with slopes on the projectile that are less than eight degrees, rather than the currently mentioned fifteen degrees, and this type of projectile is also greatly needed.

BRIEF SUMMARY OF THE INVENTION

A family of extended range (guidance adaptable) 40 mm cartridges are presented which could be launched from a conventional M203 or M320 gun launcher device. The projectiles are provided with extendible fins of one to five inch length thereon, not heretofore possible, are launched and also fly with no appreciable spin. Therefore, the projectiles can have a guidance navigation and control, canard actuating system therein, not heretofore possible, and yet can still be launched from a conventional M203 or M320 gun launcher device. Therefore, these projectiles can be used to kill moving as well as stationary targets with great accuracy and lethality, something not heretofore possible in a conventional M203 or M320 tube launched cartridge. The projectiles also provide an angle of the tail cone that is between five to seven degrees, not heretofore possible, which contributes to enhanced reduction of drag, thus increased range and accuracy. A choice of more lethal warheads is also now available because more room is made available for such inside these new projectiles than heretofore was possible.

OBJECTS OF THE INVENTION

Accordingly, it is an object of the present invention to provide an enhanced stability extended range (guidance adaptable) 40 mm cartridge which could be launched from a conventional M203 or M320 gun launcher device.

Another object of the present invention is to provide an enhanced stability extended range (guidance adaptable) 40 mm cartridge which could be launched without any appreciable spin of its projectile, from a conventional M203 or M320 gun launcher device.

It is a further object of the present invention to provide an enhanced stability extended range (guidance adaptable) 40 mm cartridge having a projectile with extendible fins of one to five inch length thereon, and yet can still be launched from a conventional M203 or M320 gun launcher device.

It is a yet another object of the present invention to provide an enhanced stability extended range (guidance adaptable) 40 mm cartridge having a projectile with a guidance navigation and control, canard actuating system therein, and yet can still be launched from a conventional M203 or M320 gun launcher device.

It is a still further object of the present invention to provide an enhanced stability extended range (guidance adaptable) 40 mm cartridge having a projectile thereon wherein the angle of the tail cone is between five to seven degrees, to contributes to enhanced reduction of drag, and yet can still be launched from a conventional M203 or M320 gun launcher device.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention. The invention, as but one non-exhaustive example, could be used on grenade launchers other than an M320, including stand alone devices to receive a grenade launcher, other types of shoulder launched weapons, or weapons other than grenade launchers, and for ammunition other than necessarily the caliber or types shown here, where the principles of the invention might be beneficially employed.

LIST OF FIGURES

DETAILED DESCRIPTION OF THE INVENTION

Figure 1:
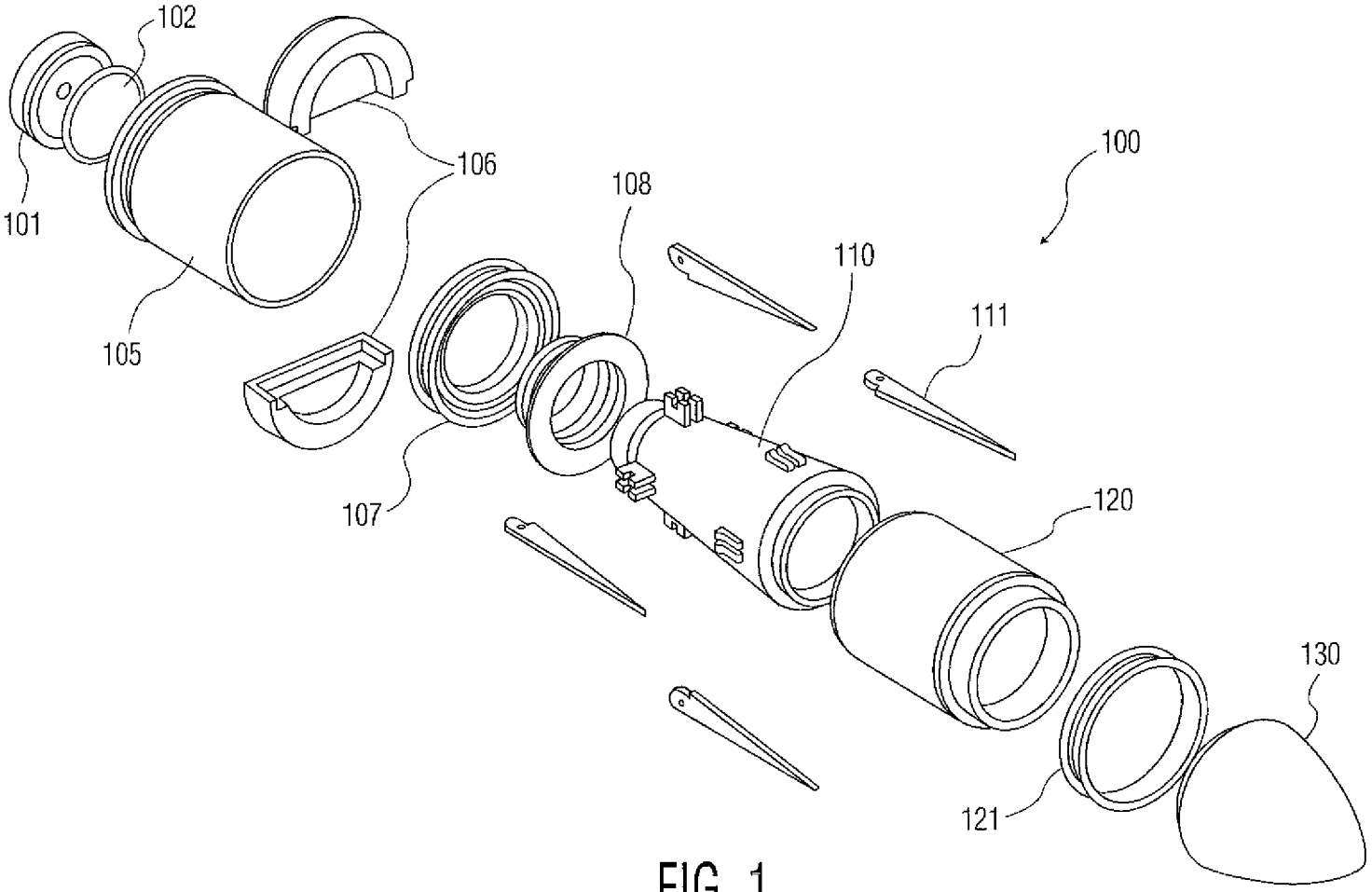
FIG. 1 shows an exploded view of the enhanced stability extended range (guidance adaptable) 40 mm cartridge according to this invention.

An entirely new projectile is hereby presented for use in M203 or M320 grenade launcher devices which projectile will not be appreciably spun up by the launcher barrel rifling at all; has fins that are two inches or longer; allows for aggressive addition of guidance, navigation and control (GN&C) systems; and also now allows for targets to be engaged when those targets are either stationary or moving. The rear end of the projectile has slopes that are seven degrees or less, and therefore has less drag and longer range than before possible. This enhanced stability extended range (guidance adaptable) 40 mm cartridge (100) is shown in FIG. 1 in an exploded view.

Figure 2:
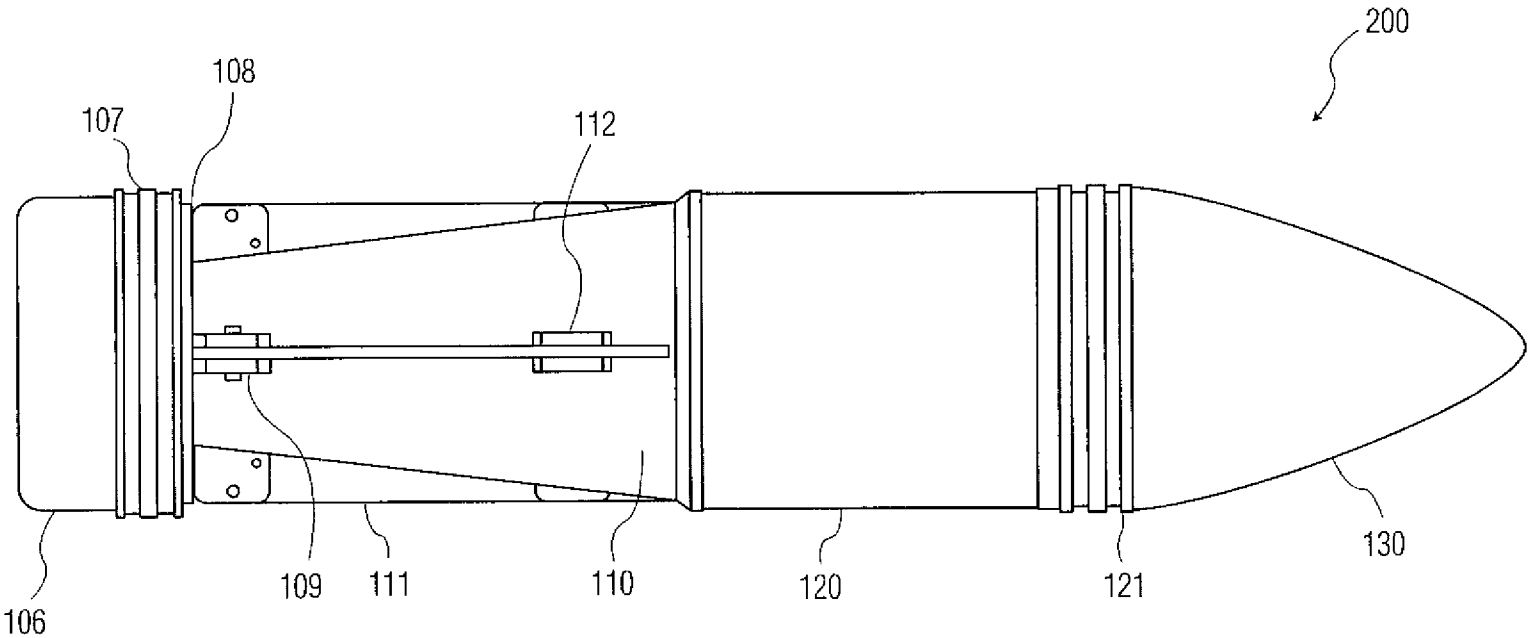
FIG. 2 shows a model of an In-bore enhanced stability extended range (guidance adaptable) 40 mm cartridge according to this invention.
Figure 3:
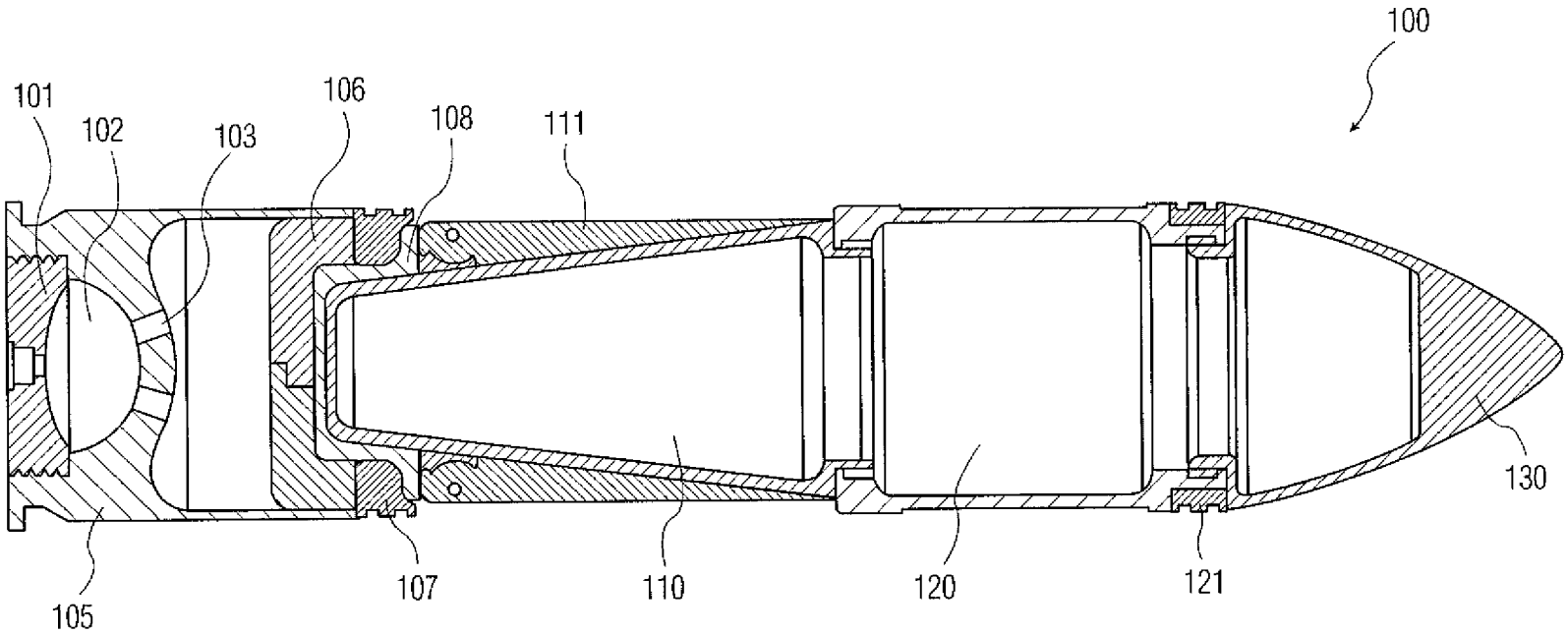
FIG. 3 shows a cutaway view of the enhanced stability extended range (guidance adaptable) 40 mm cartridge according to this invention.
Figure 4:
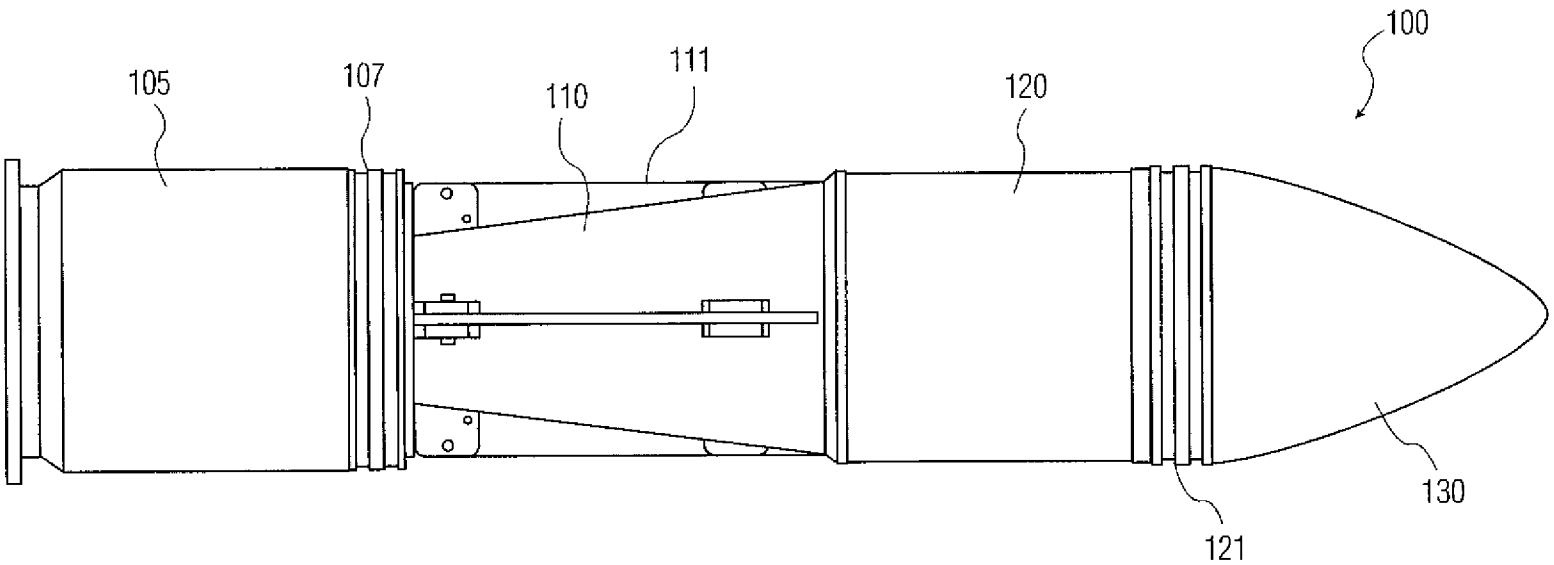
FIG. 4 shows a further model of the enhanced stability extended range (guidance adaptable) 40 mm cartridge according to this invention.
Figure 5:
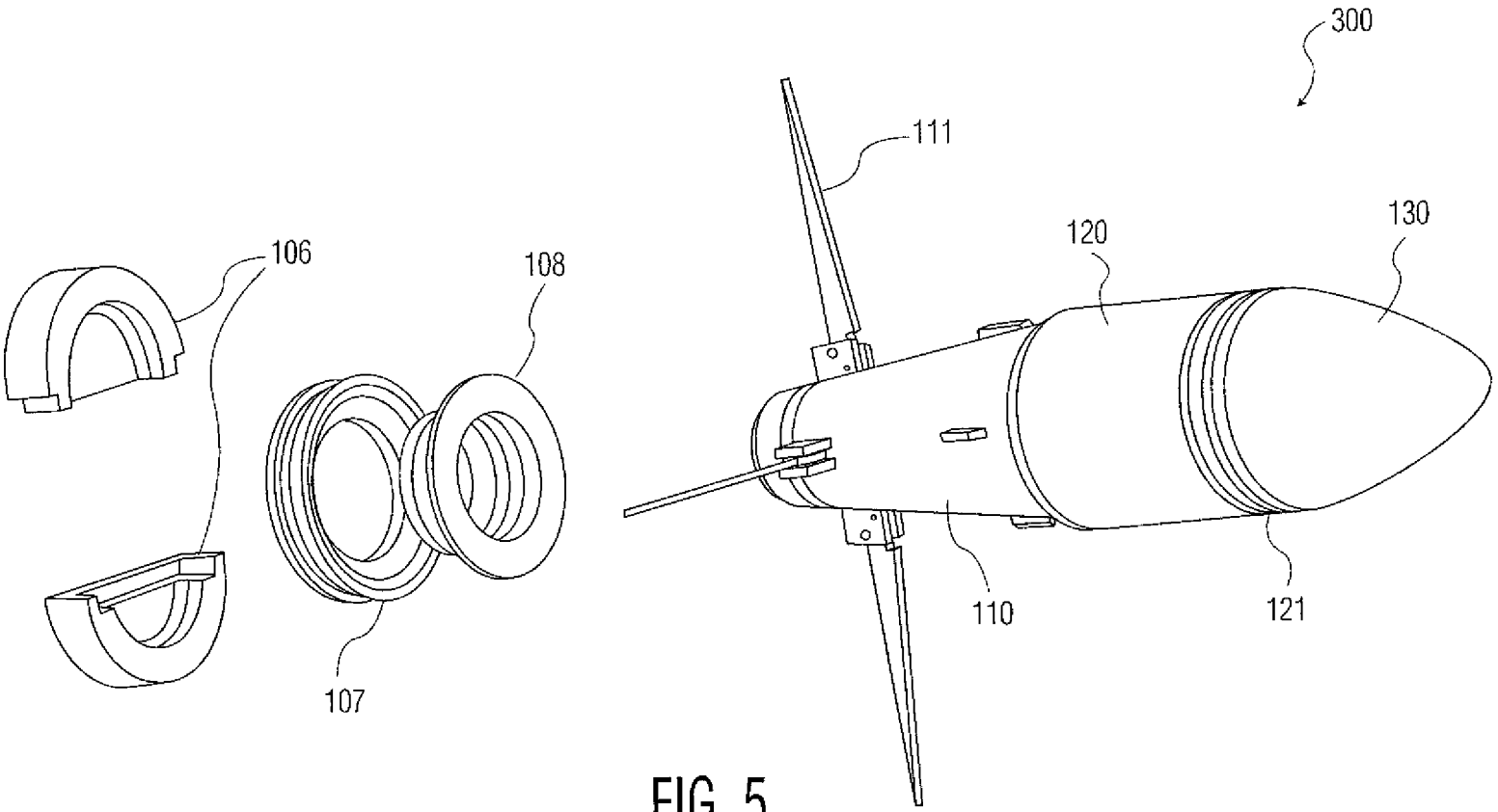
FIG. 5 shows a model of an in-flight projectile, with parasitic discarded components, according to this invention.

The cartridge (100) comprises a plug (101), a propellant holding cup (102), an enhanced cartridge case (105), a two part projectile holder cup (106), a rear obturator (107), an obturator holder cup (108), a tail cone (110), rear fins (111), a body (120), an optional front obturator (121) and a nose (130). FIG. 2 shows a model of the low velocity in-bore enhanced stability extended range (guidance adaptable) 40 mm projectile (200). This in-bore projectile (200) is the projectile that travels up the gun tube upon being fired. The in-bore projectile (200) comprises a two part projectile holder cup (106), a rear obturator (107), an obturator holder cup (108), a tail cone (110), a rear fin housing (109), rear fins (111), a front fin housing (112), a body (120), an optional front obturator (121) and a nose (130). The in-bore projectile (200) is assembled as follows. The optional front obturator (121) is slided onto the body (120). The nose (130) is then threaded onto the body (120). The four fins (111) are placed in the rear housing (109) and springs are added (springs not completely shown), which springs hold the four fins (111) open at an angle of between 90 to 120 degrees to the body (120). A rubber band (not completely shown) is added to hold the fins shut in the rear and front housings (109 and 110 respectively). Obturator holder cup (108) is then pressed onto the rear of tail cone (110) and pressed up tight against the rear fin housing (109), preventing the fins from opening due to an interference fit. Rear obturator (107) is slided onto obturator holder cup (108). The two part projectile holder cup (106) is next slid over the obturator holder cup (108). The in-bore projectile (200) is now complete. The enhanced cartridge case (105) was designed to hold more propellant and therefore provide greater velocity and extended range to the low velocity 40 mm projectile. The propellant holding cup (102) is placed in the enhanced cartridge case (105) as shown in FIG. 3. The correct desired amount of propellant is placed in the cup (102) and then plug (101) is threaded into the cup (102), thus sealing the propellant in the cup (102). The enhanced cartridge case (105) with propellant is now ready to be combined with the in-bore projectile. The in-bore projectile (200) is now pressed into the preloaded enhanced cartridge case (105) and now becomes the enhanced stability extended range (guidance adaptable) 40 mm cartridge (100), as shown in FIGS. 3 and 4. FIG. 3 is a cutaway of the extended range (guidance adaptable) 40 mm cartridge (100). FIG. 4 is a model of the extended range (guidance adaptable) 40 mm cartridge (100), and is now ready to load and fire in an M320 grenade launcher device. The functioning of the extended range (guidance adaptable) 40 mm cartridge (100) is as follows. The cartridge (100) is loaded into an M320 gun. The obturator (107) fits tightly against the position of the beginning of the rifling found in the M320 gun. Upon propellant ignition, the propellant gasses burn through cup (102) and are vented through holes (103). The propellant gases are stopped by the obturator and cause the in-bore projectile (200) to move throughout the gun tube. After the projectile (200) leaves the gun tube the parasitic components (two part projectile holder cup (106), rear obturator (107), and obturator holder cup (108)) are no longer needed and are therefore allowed to be discarded by the force of air pushing against them with hundreds of pounds of force. The fins (111) are now free to open, and open at the predetermined angle as well (usually 90 or 120 degrees). A wire going through the housing, (109) not completely shown, located on tail cone (110), catches the rear fin locking mechanism and determines the angle of all four fins (111). The in-flight projectile (300), FIG. 5, continues on to target and engages, destroys, and/or defeats, the target. The in-flight projectile (300) contains a standard 40 mm fuze, explosive and warhead (all not completely shown).

The feature that allow for the enhanced stability extended range (guidance adaptable) 40 mm Cartridge (100) to be unique and have extended range and flight stability with guidance are as follows. The obturator holder cup (108) attaches to the tail cone (110) by a press fit with grooves. The obturator (107) is placed onto the obturator holder cup (108). A two part projectile holder cup (106) is then attached to the obturator holder cup (108). The in-bore projectile (200) which contains this assembly is now pressed into the enhanced cartridge case (105). This now gives rigidity to the entire projectile (200) before loading (allows for rough handling) and true positioning of the in-bore projectile (200) when loaded into the M320 gun tube. As previously mentioned, the fins (111) are locked down in position when the obturator holder cup (108) is pressed onto the tail cone (110). The obturator holder cup (108) presses tight against the rear fin housing (109) preventing the fins from opening, due to an interference fit. During gun launch, the two part projectile holder cup (106), rear obturator (107), and obturator holder cup (108) are held tight against the in-flight projectile (200) by the constraints of the gun tube and the propellant gases. After projectile (200) leaves the gun tube, the parasitic components (two part projectile holder cup (106), rear obturator (107), and obturator holder cup (108)) are no longer needed and are discarded by the force of the air pushing against them with hundreds of pounds of force. The fins (111) are now free to open, and opening also at the predetermined angle (usually 90 or 120 degrees). The features of having the obturator and support components on the rear of the projectile now allow the fins (111) to be from 1-5 inches, which could not be done before since the length was restricted to 1 inch by the space available in the cartridge case (105) and rear obturator (107). The length of the fins (111) can be adjusted by adjusting the length of the tail cone (110) and reducing the length of the body (120) and/or nose (130). The overall projectile can be varied from 4-8 inches. Enhanced stability extended range (guidance adaptable) 40 mm projectiles (200) have been successfully tested and fired from 5-8 inches, all weighing 170-200*g*, which weight also is similar to current 40 mm ammunition. In addition, the angle of the tail cone (110) is now from 5-7 degrees which reduces drag and the shape of the fins (111) also increases lift. Previously, fins that were behind the obturator and fit in the cartridge case (105) needed at least 10 degrees; this increased drag on the projectile and reduced the range of the projectile. The new in-flight projectile (300) of this invention will also be seen to provide for extended range and accuracy (over 684 meters) through increased velocity and optimized projectile and fin shape and increased length; a capability for add-on optional guidance-navigation & control ("GN&C") for extended range and accuracy to over 1000 meters with potential to engage stationary and moving targets; increased lethality for stationary and moving targets through precision and accurate strikes; increased lethality utilizing increased projectile length which in turn allows for carrying more fragments thus increased amounts of explosives and energetics. The improved cartridge case (105) allows for more propellant to be held than the current 40 mm low velocity cartridge case. Due to the increased propellant load (greater than 50%), efficiency increase of propellant burn due to the shape of the propellant holding cup (102), the bowl (not completely shown), vents (103), and the in-flight projectile aerodynamic shape including the extended length fins (111) (the fins provide increased aerodynamic stability and are not present on any current low velocity 40 mm projectiles due to the technical challenges that this invention has overcome), the increase in velocity (from 78 m/s to 120 m/s) translates to an increase in range from approximately 400 m to over 684 meters. In addition, standard 40 mm low velocity projectiles are only accurate out to approximately 300 m whereas this in-flight projectile (300) is accurate out to over 684 meters, without GN&C. Addition of a canard activation system (CAS), which provides GN&C, will add extended range and accuracy to over 1000 meters. For the tactical in-flight projectile (300), increased lethality (compared to the current 40 mm low velocity) is achieved through increased precision and accuracy on targets and increased projectile length providing for carrying of more fragments and increased amount of explosives and/or energetics.

Figure 6:
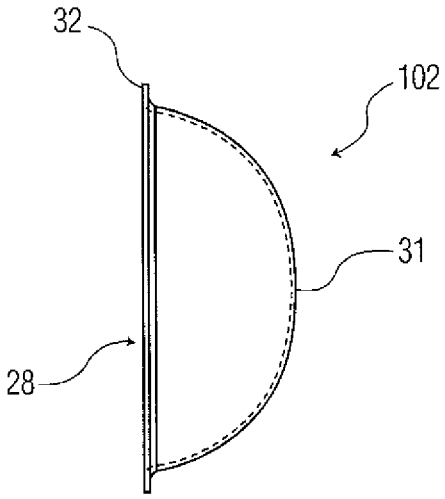
FIG. 6 shows propellant holding cup for the enhanced stability extended range (guidance adaptable) 40 mm cartridge, according to this invention.
Figure 7:
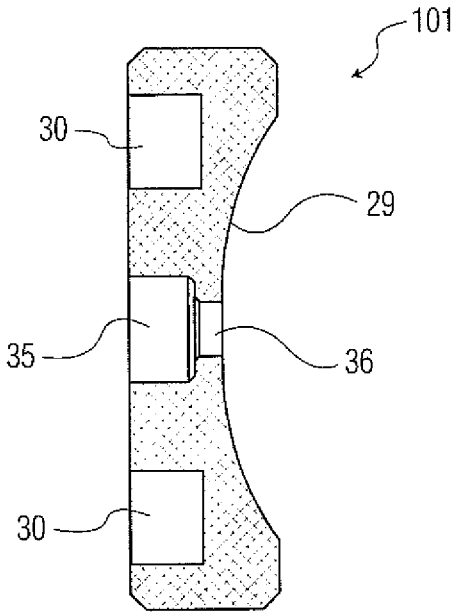
FIG. 7 shows plug which holds the propellant holding cup in place for the enhanced stability extended range (guidance adaptable) 40 mm cartridge, according to this invention.

FIG. 6 shows a cutaway drawing of the propellant closure cup 102. Cup 102 has a metal bowl part 31 which is open from the direction 28. Cup 102 has a lip part 32. Cup 102 is sized to fit right into open space and the (copper or other material) cup bowl is filled with propellant then the base plug is screwed in over it, to hold the cup in place. The propellant bowl area of the cartridge case has a much larger volume than known/used before now; it has a new shape which allows for more propellant and therefore higher velocity of the projectile with efficient burn for higher velocity per pressure output. Copper closure cup lip 32 is pressed in place by engaged closure plug 101 (see FIG. 7) and prevents propellant from coming out of the cup through the vent holes 103 (a possible number of vent holes could be six). This allows for the round to be rough handled without the threat of propellant being lost through the vent holes, which might affect velocity and pressures of the projectile. FIG. 7 is a cutaway drawing of the base plug 101. The plug has a slightly rounded open area 29 (like a large dimple area), which will assist in the propellant burning patterns as opposed to a flat surface there. The plug has a hole 35 for firing pin means and a through hole 36 to assist in the ignition of propellant in the cup (FIG. 7). The plug also has dead ended openings 30 which can receive a tool means if one wanted to rotate the plug for threading it in the base of cartridge case 10.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention. The invention for example could be used on grenade launchers other than an M320, including stand alone devices to receive a grenade launcher, other types of shoulder launched weapons, or weapons other than grenade launchers, and for ammunition other than necessarily the caliber or types shown here, where the principles of the invention might be beneficially employed.

What is claimed is:

1. An enhanced stability extended range (guidance adaptable) 40 mm cartridge (100) comprising:
a plug,
a propellant holding cup,
an enhanced cartridge case, and
a 40 mm projectile comprising:
a two part projectile holder cup,
a rear obturator,
an obturator holder cup,
a tail cone,
a rear fin housing,
rear fins,
a front fin housing,
a body,
an optional front obturator, and
a nose.

2. The cartridge as in claim 1 wherein the fins are between 1 to 5 inches in length.

3. The cartridge as in claim 1 wherein overall projectile length are varied from 4 to 8 inches by varying the length of the tail cone, reducing the length of body, and/or by reducing the length of the nose.

4. The cartridge as in claim 1 wherein the projectile includes a guidance navigation and control, canard actuating system, added between the body and nose thereof.

5. The cartridge as in claim 4 wherein said included guidance navigation and control, canard actuating system makes possible the attacking of stationary and moving targets.

6. The cartridge as in claim 1 wherein the obturator holder cup is pressed onto the rear of tail cone tight against the rear fin housing, this preventing the fins from opening due to an interference fit.

7. The cartridge as in claim 1 wherein propellant gasses burn through a copper cup and escape through vent holes and are stopped by the obturator to propel an in-bore projectile to move rapidly through the gun tube to be launched.

8. The cartridge as in claim 7 wherein after the projectile leaves the gun tube, the two part projectile holder cup, rear obturator, and obturator holder cup, are all separated and discarded by flight air pressures.

9. The cartridge as in claim 8 wherein discarding of the projectile holder cup, rear obturator, and obturator holder cup enables the fins to open, at angles of 90 or 120 degrees.

10. The cartridge as in claim 9 wherein the fin blades have a canted angle to relatively slowly spin up the projectile during firing.

11. The cartridge as in claim 1 wherein the projectile carries a payload which includes any of: selected energetic materials, an explosive liner, fragmentation projectiles, or a selected warhead.

* * * * *